US005143294A

United States Patent [19]

Lintvedt

[11] Patent Number: 5,143,294

[45] Date of Patent: Sep. 1, 1992

[54] PLIANT CONTAINER FOR STORAGE OF A LIQUID AND LIQUID APPLICATION THEREFROM

[76] Inventor: Arnold M. Lintvedt, 6891 Central Ave., Lemon Grove, Calif. 91945

[21] Appl. No.: 681,790

[22] Filed: Apr. 8, 1991

[51] Int. Cl.[5] ..... B05B 11/00

[52] U.S. Cl. ..... 239/328; 222/105

[58] Field of Search ..... 239/328; 222/95, 105, 222/133, 183

[56] References Cited

U.S. PATENT DOCUMENTS 3,255,972 6/1966 Hultgren et al. ..... 239/328

4,322,020 3/1982 Stone ..... 239/328

FOREIGN PATENT DOCUMENTS 474179 1/1976 Australia ..... 239/328

*Primary Examiner*—Kevin P. Shaver

*Assistant Examiner*—Lesley D. Morris

*Attorney, Agent, or Firm*—Frank D. Gilliam

[57] ABSTRACT

A pliant container for a liquid paint or insecticide product or the like from which the liquid therein can be applied thereof rom by a conventional liquid spray device. The container is sealed except for a opening at or near one end thereof from which a conventional spray device can be sealedly attached. The dip tube or siphon tube from the spray device is inserted throught the opening and sealed therein by means of a frusto conic plug through which the dip or siphon tube is inserted. The container with the liquid therein is then placed into the normal liquid holding canister associated therewith and the spray device is then operated in its normal manner for dispensing the liquid through its spray nozzle. After the container is emptied, it can be refilled for future use or discarded. The spray device and canister require a minimum of cleaning after use with the pliant container.

3 Claims, 1 Drawing Sheet

PLIANT CONTAINER FOR STORAGE OF A LIQUID AND LIQUID APPLICATION THEREFROM

BACKGROUND OF THE INVENTION

The invention is directed to container for containing a liquid and more particularly to a pliant container for containing paint, insecticide or the like for storage and application therefrom from a conventional liquid spraying device such as, a paint gun, an insecticide spray gun for water house attachment, a pressurized liquid dispensing device or the like. The device can be used for storage of a liquid such as paint or concentrated insecticide or the like and can be re-used or discarded. The container is transparent so that the contents thereof can be readily displayed.

U.S. Pat. No. Re. 24,918 issued to L. E. Mills in 1961 teaches a pliant container for containing and dispensing low boiling liquids therefrom.

U.S. Pat. No. 3,203,484 issued to F. Ruggiero in 1965 teaches a portable fire extinguishing device utilizing a pliant container from which foam is discharged by means of winding the container upon itself for mixing and dispensing the foam therefrom.

U. S. Pat. No. 3,255,972 issued to Ralph J. Hultgren in 1966 teaches a pliable container for use with a sprayer generally of the type adapted to be connected to a hose for watering lawns or flowers or the like. In particular the invention pertains to sprayers of this character wherein the chemical to be mixed with the water stream is contained in a disposable collapsible container or cartridge having an aspiring tube extending into the water stream and further containing means for applying the stream of water pressure to the outer surfaces of the collapsible container to force the liquid chemical through the aspiring tube into the water stream. This device requires the normally rigid container of the spray device as well as a separate rigid container with apertures through its walls positioned within the normal rigid container of the spray device for filling with water for dispensing the chemical from the flexible container.

There has not been a pliant liquid container that can be readily attached use with a conventional spray device such as a pressure spray gun or the like without modifying the spray device or requiring the addition of other components to the spray device for use, that has transparent walls so that the contents therein can be readily identified especially when the contents is paint and color is identifiable, that can be refilled when empty for future use or is inexpensive until the emergence of the present invention.

SUMMARY OF THE INVENTION

The invention is directed to a pliant container that can be filled with a liquid, inserted in a conventional canister of a spray device, particularly a conventional paint spray gun or the like, and sealed to the dip of siphon tube from which the liquid there in can be dispensed and from the nozzle of the device. The pliant container is sealed on all sides so as to be liquid tight. On one end of the pliant container or adjacent thereto an opening is provided. The opening is sealed by a selectively removable sealing cap, shown as a threaded or screw on cap.

To prepare the pliant container for use the sealing cap is removed and a similar cap with a central opening for the dip tube to pass therethrough is provided. A frusto conic resilient plug having a central opening through which the dip tube passes and when in use the opening registers with the opening in the screw cap. The plug is placed between the opening in the pliant container and the inside of the screw cap and the dip tube is inserted through the opening in the cap and the plug. The plug end is insertable into the opening in the pliant container and when the cap is screwed onto the threads around the opening the plug is forced into the opening in the pliant container and against the dip tube sealing the container and the dip tube as an integral sealed unit. The sprayer is now ready to dispense the liquid from the pliant container.

Prior to the inserting the pliant container into the canister if mixing of the liquid is required the pliant container can be kneaded while in a sealed condition to preform a mixing operation.

When all of the liquid is dispensed from the pliant container, the pliant container can be removed by reversing the above sequence and be refilled with a like liquid or discarded. The spray gun now only requires a minimal amount of cleaning for future use with the same or different liquid.

An object of this invention is to provide a pliant container for containing a liquid to be dispensed from a conventional spray device that can be used with the device without modification thereof.

Another object of this invention is to provide a liquid container which can be used in a conventional paint spray gun to apply the liquid from the gun nozzle without regard to the position of the spray gun which will not cause the liquid to leak from the container into the vent opening of the spray gun canister or leak from the canister.

Another object of this invention is to provide a pliant container for a liquid that can be used with a conventional pressure spraying device, such as, a paint application sprayer that requires a minimum of sprayer clean up after completing the spraying of the liquid from the pliant container.

Yet another object of this invention is to provide a pliant container for paint or the like that can be sealed to the delivery or dip siphon tube of a conventional paint sprayer gun so that the normal paint gun paint canister does not require cleaning after the application of paint from the pliant container.

Still another object of this invention is to provide a pliant container for paint or the like which is transparent so the color of the paint can be readily determined by visual means.

A further object of this invention is to provide a pliant liquid container filled with a liquid from which a portion of the liquid can be removed and the remaining liquid can be stored in the pliant container for future use.

A still further object of this invention is to provide a pliant container wherein the contents thereof can be mixed by kneading the container while sealed thereby not require stirring or the like.

Other objects and features of the invention will become apparent as the drawings which follow are understood by reading the corresponding description thereof.

BRIEF DESCRIPTION OF THE DRAWING FIGURES

DETAILED DESCRIPTION OF THE PREFERRED EMBODIMENT

Figure 1:
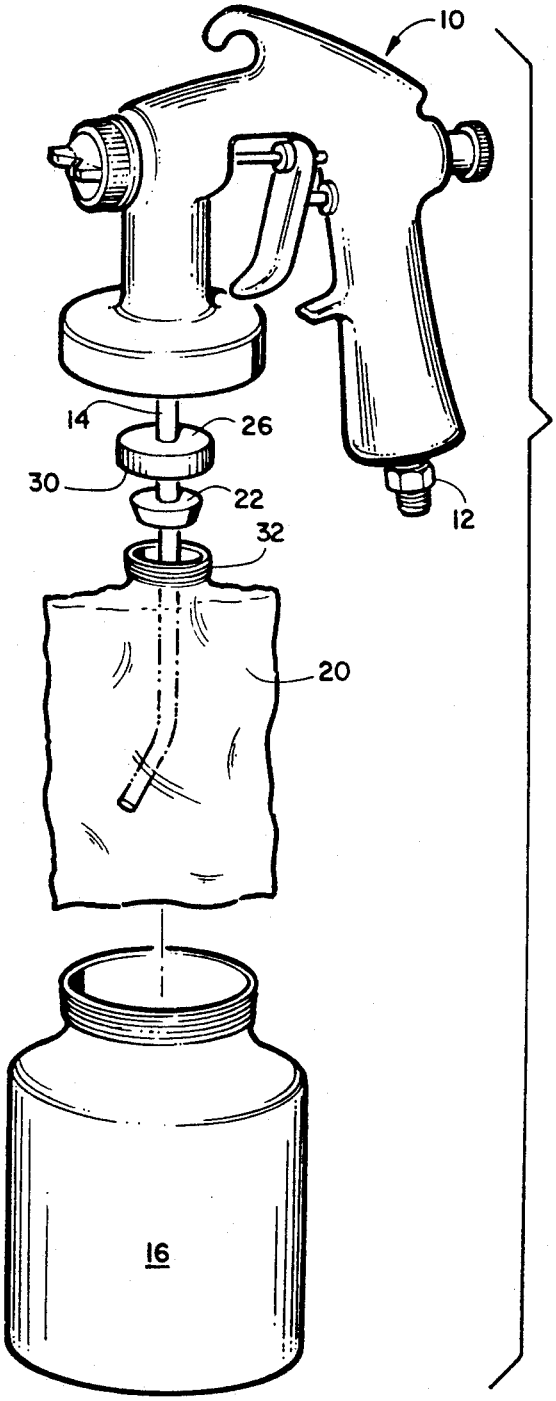
FIG. 1 is an exploded showing of a paint spray gun, the pliant container of the present invention and spray gun paint cup.

Referring now to the various drawing Figures, FIG. 1 depicts an exploded showing of a conventional hand held paint gun 10. The gun has a pressured gas inlet at connection 12 for normal operational pressurization thereof. A siphon or dip tube 14 extends from the bottom of the gun. The tube normally extends into the cup 16 terminating near the bottom thereof. The cup is normally filled with the liquid paint desired to be applied with the gun through nozzle 18 in a conventional and well known operational manner.

A pliant container 20 of the invention is sealingly attachable to the siphon or dip tube by means of a frusto conic resilient plug 22 with a central aperture 24 not unlike those rubber plugs used in the field of chemistry. A sealing cap 26 with a central aperture 28 which aligns with the aperture 24 and threads 30 threadedly engages mating threads 32 on the pliant container.

When the pliant container is sealed to the siphon or dip tube 14 in a manner hereinafter explained in detail, the pliant container is inserted into the cup 16 and the cup is secured to the gun in a conventional manner, generally by threads or a bayonet connection common in the industry.

Figure 2:
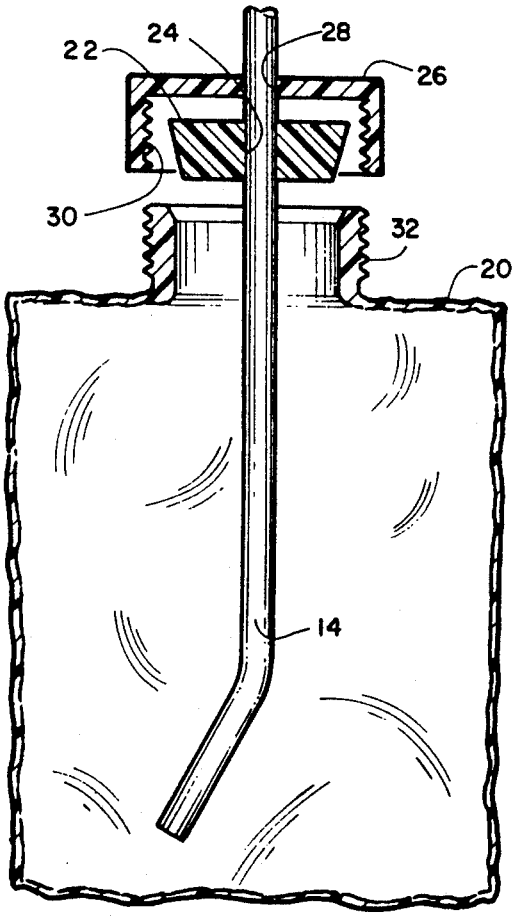
FIG. 2 is an enlarged showing of the plaint container of the present invention sealed to the siphon or deliver tube of the paint sprayer.

The pliant container 20 is sealed to the siphon or dip tube, as shown in drawing FIG. 2, in the following manner, The siphon or dip tube is inserted through aperture 28 in the sealing cap 26 and aperture 24 in the resilient pug 22, the sealing cap 26 is then screwed in a tightening manner onto the threads of the pliant container thereby forcing the frusto plug against the walls of the opening in the pliant container and the siphon or dip tube 14. The pliant container is now sealed and ready for placement into the cup of the spray gun for spraying the liquid thereof rom.

Figure 3:
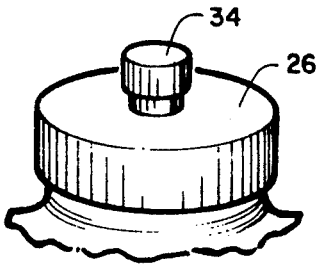
FIG. 3 is a top plan view of the pliant container of the device sealed prior to use.

After use if the pliant container is empty it can either be refilled which is preferable for ecology reasons or can be discarded. If after use, the paint in the pliant container is only partially used it can be resealed with a cap with the aperture 28 sealed with a removable plug 34, see FIG. 3, which was originally on the pre-filled pliant container 20.

Although the description describes the use of the pliant container of the invention with a paint spraying gun it should be understood that the pliant container of the present invention can be utilized with any siphon or dip tube spraying device.

It should be further understood that the pliant container of the invention will work equally as well in those spray devices where the normal liquid cup is pressurized to aid in the delivery of the liquid to the spray nozzle.

It should be understood the liquid in the container can be mixed when required by simply kneading the sealed plaint container between the hands of the user.

It should be further understood that the canister of a conventional spray gun utilizing the instant invention can be rotated from it normal position any other position including, but not limited to, an inverted position and yet function in a normal manner without plugging the vent tube or spilling liquid from the canister.

While specific embodiments of the pliant container and its sealing means has been shown and fully explained above for the purpose of illustration it should be understood that many alterations, modifications and substitutions may be made to the instant invention disclosure without departing from the spirit and scope of the invention as defined by the appended claims.

What is claimed is:

1. An improved liquid container for a spraying device for storage of the liquid for dispensing from the spraying device, said spraying device having a spray nozzle and a siphon or dip tube having a distal end for delivery of the liquid from the storage container to said nozzle comprising:

said improved container being pliant, having a sealable opening and sealing means for sealingly engaging said siphon or dip tube inserted into said opening with said distal end extending substantially to the opposite side of said improved container, said sealing means comprises a removable cap for said opening having a central aperture and a resilient frusto conic plug having a central aperture for insertion between said removable cap and said opening whereby said apertures are in alignment and said siphon or dip tube extends through said central apertures into said improved pliant container, means for translating said removable cap toward said opening, whereby when said removable cap is translated toward said opening said resilient plug is forced against said opening and said siphon or dip tube sealing said opening and said siphon or dip tube together.

2. The improved liquid container as described in claim 1 additionally comprising a sealing means for sealing said sealable opening in said improved liquid container when said improved liquid container is removed from it sealing engagement with said siphon or dip tube.

3. The improved container as described in claim 2 wherein said means for translating said removable cap toward said opening comprises threads on the inside surface of said cap and on the outside surface of said opening whereby when the cap threads engage the threads on said opening and the cap is rotated said frusto conic plug is compressed against said opening and said siphon or dip tube.

* * * * *